US009573267B2

(12) United States Patent
Fegan

(10) Patent No.: US 9,573,267 B2
(45) Date of Patent: Feb. 21, 2017

(54) HAND IMPLEMENT

(71) Applicant: Peter Dominic Fegan, Queensland (AU)

(72) Inventor: Peter Dominic Fegan, Queensland (AU)

( * ) Notice: Subject to any disclaimer, the term of this patent is extended or adjusted under 35 U.S.C. 154(b) by 318 days.

(21) Appl. No.: 14/052,734

(22) Filed: Oct. 12, 2013

(65) Prior Publication Data

US 2014/0103276 A1 Apr. 17, 2014

(30) Foreign Application Priority Data

Oct. 12, 2012 (AU) ..... 2012904481

(51) Int. Cl.
*B25G 1/10* (2006.01)
*B25D 1/04* (2006.01)

(52) U.S. Cl.
CPC ..... *B25G 1/102* (2013.01); *B25D 1/04* (2013.01); *Y10T 16/476* (2015.01)

(58) Field of Classification Search
CPC ..... B25G 1/102; Y10T 16/476; B25D 1/00; B25D 1/12
See application file for complete search history.

(56) References Cited

U.S. PATENT DOCUMENTS 412,479 A * 10/1889 Davis ..... A63B 49/08 15/143.1
1,830,663 A * 11/1931 Keating et al. ..... B25D 1/00 30/308.1
2,628,100 A * 2/1953 Bayard ..... A63B 53/16 473/203
3,385,334 A * 5/1968 Clay ..... B25D 1/00 16/430
3,868,110 A * 2/1975 Jones ..... A63B 49/08 16/DIG. 12
3,879,048 A * 4/1975 Penney ..... A63C 11/222 280/821
4,828,310 A * 5/1989 Schmidt, Jr. ..... A45F 5/004 294/150
4,934,024 A * 6/1990 Sexton ..... A63B 49/08 16/421
5,067,194 A * 11/1991 Rosenfeld ..... A47K 7/08 15/144.2
5,359,818 A * 11/1994 Costa ..... B25G 1/102 451/492
5,456,463 A * 10/1995 Dolan ..... A63B 59/70 473/563
5,692,265 A * 12/1997 Dalury ..... B25D 1/00 16/421
6,145,151 A * 11/2000 Herron ..... A46B 5/02 15/143.1
6,199,642 B1 * 3/2001 Becker ..... B25B 21/00 173/216
6,405,616 B1 * 6/2002 Chen ..... B25G 1/01 81/20

(Continued)

*Primary Examiner* — David B Thomas

(57) ABSTRACT

The present invention relates to a handle for a hand implement. The handle defines thumb indentations for receiving a thumb. Advantageously, the thumb can be positioned in particular thumb indentations to suit user preference or functional operation of the implement. Preferably, the handle defines a bight opposite the thumb indentations. The handle may define finger indentations in the bight. The finger indentations may be located closer a free end of the handle than the thumb indentations.

15 Claims, 3 Drawing Sheets

(56) References Cited

U.S. PATENT DOCUMENTS 6,419,601 B1 * 7/2002 Kenner ..... A63B 49/08 16/430
6,723,279 B1 * 4/2004 Withers ..... A63B 53/04 419/12
6,805,642 B2 * 10/2004 Meyer ..... A63B 59/0092 473/320
6,874,187 B2 * 4/2005 Tague ..... B67B 7/92 225/93
7,185,436 B2 * 3/2007 Murphy ..... A47J 17/02 30/123.6
7,284,300 B1 * 10/2007 Bruns ..... B25G 1/102 16/110.1
7,404,346 B2 * 7/2008 Youngren ..... B25G 1/01 81/20
7,694,391 B2 * 4/2010 Skillas ..... A45F 5/102 16/430
7,930,804 B2 * 4/2011 Cornfield ..... B25G 1/102 16/430
8,042,216 B2 * 10/2011 Jochim ..... A46B 5/02 119/615
8,065,774 B2 * 11/2011 Schiesz ..... A46B 5/0083 15/143.1
8,434,954 B2 * 5/2013 Gitman ..... B25G 1/102 16/430
8,438,769 B1 * 5/2013 Ghannam ..... F41G 11/003 16/430
8,549,712 B2 * 10/2013 Cornfield ..... B25G 1/102 16/430
8,616,098 B1 * 12/2013 Rosow ..... B25G 1/102 16/430
8,671,806 B2 * 3/2014 Lindblom ..... B25B 23/16 81/124.1
8,745,825 B2 * 6/2014 Gitman ..... B25G 1/102 16/430
8,850,662 B2 * 10/2014 Gitman ..... A61B 17/3213 16/430
9,032,580 B2 * 5/2015 Freuler ..... B25G 1/00 15/143.1
2004/0244545 A1 * 12/2004 Stinnissen ..... B25D 1/04 81/489
2005/0178243 A1 * 8/2005 Schoor ..... B25D 1/045 81/20
2005/0241111 A1 * 11/2005 Prokop ..... B25G 1/102 16/430
2007/0028462 A1 * 2/2007 Skrivan ..... A63B 29/08 30/308.1
2007/0071843 A1 * 3/2007 Jackson ..... A47J 43/288 425/276
2007/0101547 A1 * 5/2007 Egeland ..... B25G 1/102 16/430
2007/0131061 A1 * 6/2007 Chen ..... B25D 1/00 81/20
2010/0095487 A1 * 4/2010 Gitman ..... B43K 23/008 16/430
2010/0185139 A1 * 7/2010 Stearns ..... A61B 17/3474 604/26
2010/0263219 A1 * 10/2010 Kempker ..... B25F 1/02 30/337
2010/0325901 A1 * 12/2010 Catalano ..... B25G 1/102 30/340
2011/0203426 A1 * 8/2011 Cornfield ..... B25G 1/102 81/489
2011/0302744 A1 * 12/2011 Heckel ..... B25G 1/10 16/430
2012/0082509 A1 * 4/2012 Belcher ..... A46B 5/0095 403/343
2012/0110787 A1 * 5/2012 Quiggins ..... B25G 1/102 16/430
2013/0061724 A1 * 3/2013 Lin ..... B25G 1/105 81/489
2013/0145909 A1 * 6/2013 Rogers ..... B25G 1/102 81/492
2013/0180067 A1 * 7/2013 Haigh ..... A46B 5/0075 15/106
2013/0192028 A1 * 8/2013 Pierce ..... A61M 37/0076 16/430
2013/0283541 A1 * 10/2013 Cridlebaugh ..... B25C 11/00 7/144
2014/0075693 A1 * 3/2014 Maslow ..... A46B 5/02 15/145

* cited by examiner

HAND IMPLEMENT

TECHNICAL FIELD

The present invention generally relates to hand implements including hand tools. The present invention has particular, although not exclusive application to hammers.

PRIORITY

This application claims the priority of a foreign application, namely Australian Patent Application No. 2012904481, under 35 U.S.C. 119(b) and 37 CFR 1.55(d).

BACKGROUND

The reference to any prior art in this specification is not, and should not be taken as an acknowledgement or any form of suggestion that the prior art forms part of the common general knowledge.

Since the dawn of time, humans have used hand operated implements and tools to assist in daily activities. For example, builders use a vast array of hand tools including hammers and trowels throughout the day. Undesirably, the actions performed by many hand tools are repetitive. Further, some tools such as hammers involve high impact or stresses on the hand which can result in long term injury.

Additionally, women are often reluctant to use hand tools and are therefore more inclined to call upon a handyman, even for small tasks.

The applicant has perceived a need for an ergonomic hand implement which is well suited to use by women. The preferred embodiment provides such an implement in the form of a claw hammer.

SUMMARY OF THE INVENTION

According to one aspect of the present invention, there is provided a handle for a hand implement, the handle comprising thumb indentations for receiving a thumb. Advantageously, the thumb can be positioned in particular thumb indentations to suit user preference or functional operation of the hand implement.

The handle may comprise a bight opposite the thumb indentations. The handle may comprise an enlarged free end to impede slipping of the hand. The handle may define finger indentations in the bight. The finger indentations may be located closer the free end than the thumb indentations. The handle may comprise a necking adjacent the finger indentations to facilitate gripping between a thumb and a pointer finger.

The handle may generally curve one-way and then another in an "S" like manner. The handle can comprise a magnesium core coated with a protective coating. The protective coating can comprise titanium. The handle may comprise an over-molded grip. A working end of the handle may comprise a truss.

According to another aspect of the present invention, there is provided a hand implement comprising the handle.

The hand implement may be a claw-hammer comprising a head. The head may comprise an aperture. The head may be integrally formed with the handle. The free end of the handle may curve toward the front of the hammer. The fixed end of the handle may curve toward the rear of the hammer.

According to another aspect of the present invention, there is provided a handle for a hand implement, the handle comprising a bight with a plurality of finger indentations.

According to another aspect of the present invention, there is provided a handle for a hand implement, the handle comprising a necking adjacent the finger indentations to facilitate gripping between a thumb and a pointer finger.

According to another aspect of the present invention, there is provided a handle for a hand implement, the handle comprising a truss.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
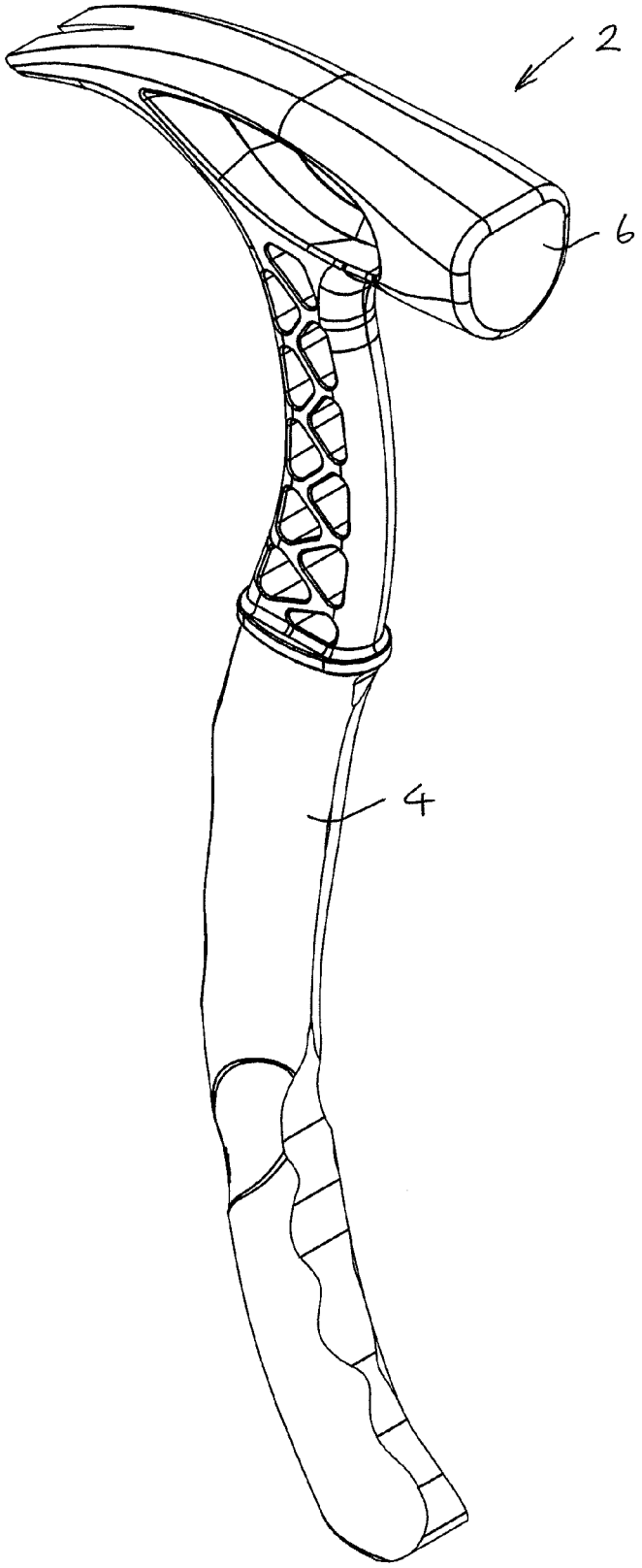
FIG. 1 is an upper perspective view of a claw hammer in accordance with an embodiment of the present invention.
Figure 2:
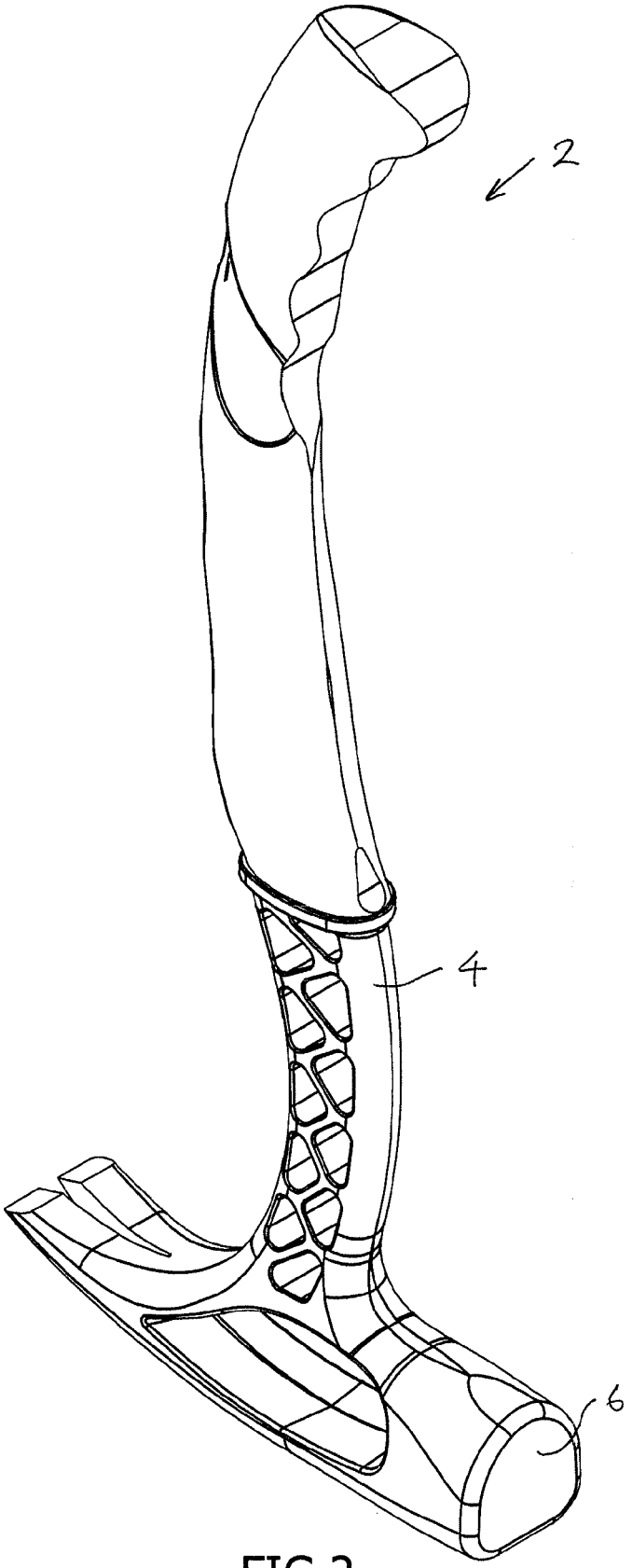
FIG. 2 is a lower perspective view of the claw hammer of FIG. 1.

According to an embodiment of the present invention, there is provided a claw-hammer 2 as shown in FIGS. 1 to 5. Turning to FIGS. 1 and 2, hammer 2 has a generally S-shaped handle 4 extending from a head 6.

Figure 3:
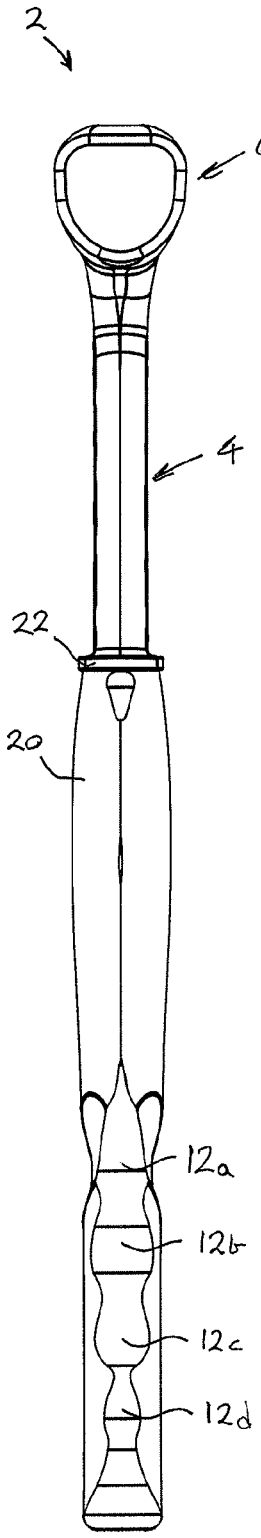
FIG. 3 is a front view of the claw hammer of FIG. 1.
Figure 4:
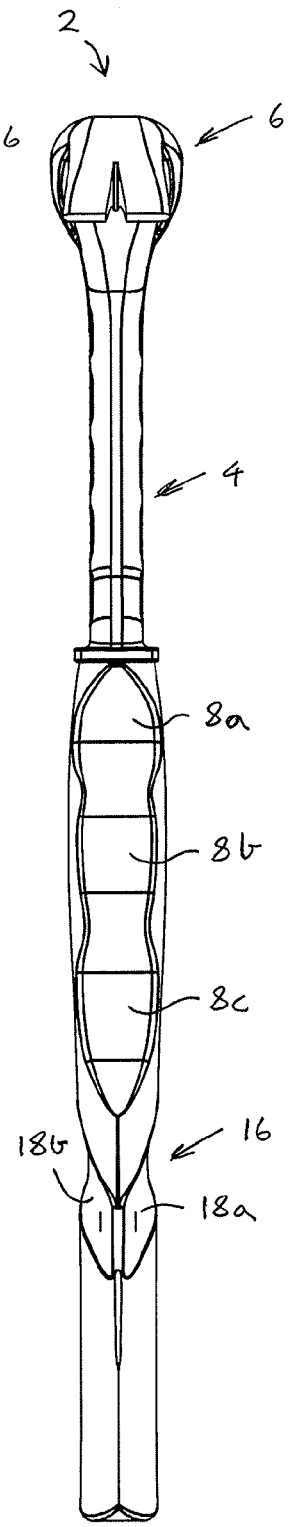
FIG. 4 is a rear view of the claw hammer of FIG. 1.
Figure 5:
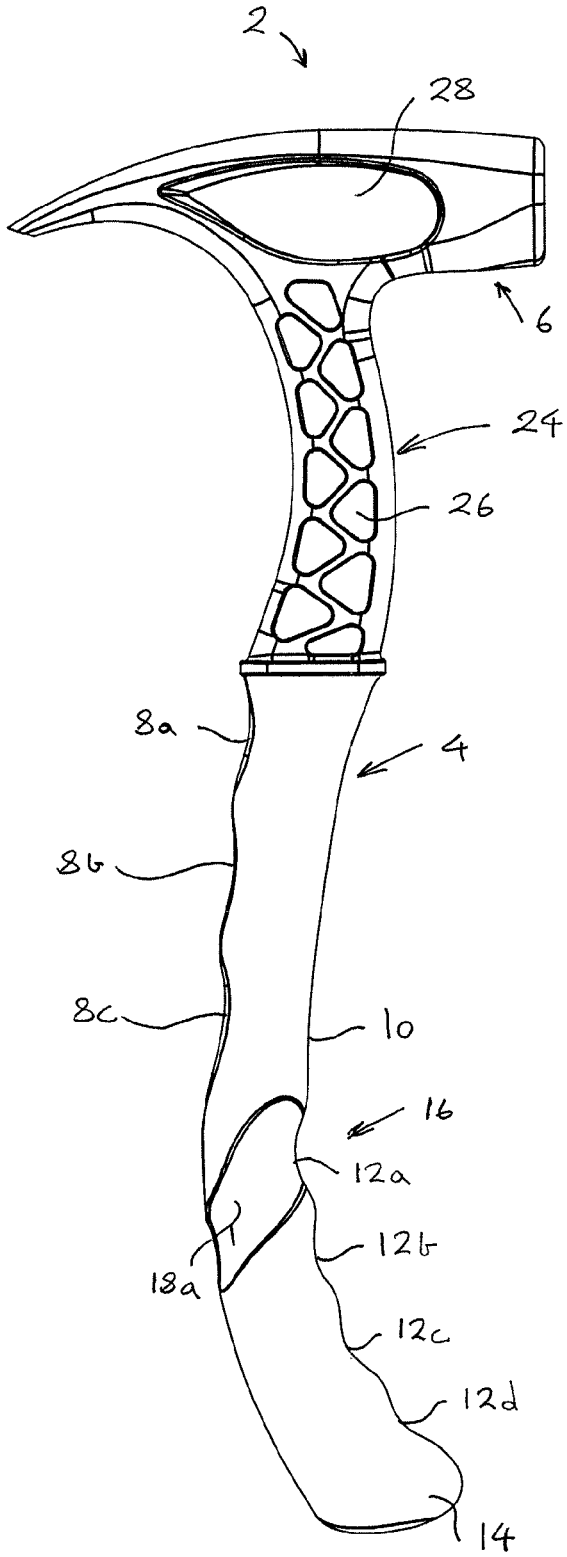
FIG. 5 is a side view of the claw hammer of FIG. 1.

As can best be seen in FIGS. 4 and 5, the handle 4 defines comprises a three thumb plurality of indentations 8*a*, 8*b*, 8*c* for receiving a thumb. Turning to FIG. 5, the handle 4 defines a lower bight 10 opposite of the thumb indentations 8*a*, 8*b*, 8*c*. As can best be seeing in FIGS. 3 and 5, the handle 4 also can comprise four plurality of finger indentations 12*a*, 12*b*, 12*c*, 12*d* in the lower end of the bight 10 closer to the free end than the thumb indentations 8*a*, 8*b*, 8*c*. At the free end, the base of the handle 4 defines an enlarged deer-foot 14 to impede slipping of the handle 4 from the hand in use.

Turning to FIGS. 4 and 5, the handle 4 defines a necking 16 adjacent the to each of finger indentations 12*a*, 12*b*, 12*c* to facilitate gripping between a thumb and pointer finger. The necking 16 can comprise two opposite slots 18*a*, 18*b* that extend upwardly toward the front of the hammer 2.

The lower free end of the handle 4 curves toward the front of the hammer 2 whereas the upper fixed end of the handle 4 curves toward the rear of the hammer 2. In this manner, the handle 4 generally curves one way and then the other in an "S" like manner. The handle 4 can comprise a magnesium core coated with a titanium protective coating. Advantageously, the magnesium core is lightweight and provides desirable vibration dampening properties.

As shown in FIG. 3, the handle 4 also can comprise a lower rubber over-molded grip 20 extending down from a top rib 22 and encapsulating the free end of the magnesium core. The handle 4 and head 6 are integrally formed of magnesium (i.e. cast or formed of a single piece) prior to the application of the grip 20.

As can best be seen in FIG. 5, the upper working end of the handle 4 can define a truss 24, in turn, defining a number of apertures 26. The head 6 also can define an aperture 28. The apertures 26, 28 generally have rounded corners to minimize fracturing owing to stresses and advantageously reduce the weight of the upper portion of the hammer 2. Further, the apertures 26, 28 serve to dampen vibrations when compared with alternative solid handles.

The hammer provides a lightweight and ergonomic design, and is particularly well suited to operation by women owing to its light weight and guide indentations.

In use when hammering a nail, the user's hand is initially positioned in the middle of the handle 4 with the thumb engaged in one of the thumb indentations 8*a*, 8*b*, 8*c* when lightly tapping the nail. The thumb can be placed in any one of the indentations 8*a*, 8*b*, 8*c* based upon preference, or can later be placed in lower thumb indentations 8*b* and then 8*c* to increase the nail tapping force.

Once the nail is tapped so that it is retained in wood, the hand may grip the base of the hammer 2 to drive the nail. A V-grip is adopted with the thumb and pointer finger engaged in the slots 18*a*, 18*b* of the necking 16, and the pointer, middle, ring and small fingers located in respective finger indentations 12*a*, 12*b*, 12*c*, 12*d*. The enlarged deer-foot 14 impedes slipping of the handle 4 from the hand when firmly driving the nail.

The ergonomic and vibration-dampening handle 4 provides for a more user-friendly hammer 2 with more comfortable grip when compared with prior art hammers. The user relaxes with a more natural handgrip when using the hammer 2, which desirably reduces muscle strain and the potential for injury.

A person skilled in the art will appreciate that many embodiments and variations can be made without departing from the ambit of the present invention.

In one embodiment, the handle 4 can comprise titanium, fiberglass or steel.

The preferred embodiment was described in relation to a hammer. The present invention has application to other hand implements including, for example, a hatchet, trowel, chisel, knife, and cooking pot.

In compliance with the statute, the invention has been described in language more or less specific to structural or methodical features. It is to be understood that the invention is not limited to specific features shown or described since the means herein described comprises preferred forms of putting the invention into effect.

What is claimed is:

1. A handle comprising a plurality of thumb indentations, each of said thumb indentations capable of receiving a thumb;

a bight opposite said thumb indentations; and finger indentations in said bight, said finger indentations being located toward an end of said bight.

2. The system of claim 1, wherein each of said finger indentations are located closer a free end of said handle than said thumb indentations.

3. The system of claim 1, wherein said handle comprises a necking adjacent said finger indentations to facilitate gripping between a thumb and pointer finger.

4. The system of claim 1, wherein said handle comprises an enlarged free end to impede slipping of the hand.

5. The system of claim 1, wherein said handle generally curves one way and then another in an "S" like manner.

6. The system of in claim 1, wherein said handle comprises a magnesium core coated with a protective coating.

7. The system of claim 6, wherein said protective coating is titanium.

8. The hand implement of claim 1, wherein said handle comprises an over-molded grip.

9. The system of claim 1, wherein a working end of said handle comprises a truss.

10. A hand implement comprising a handle, said handle comprising a plurality of thumb indentations, each of said thumb indentations capable of receiving a thumb;

a bight opposite said thumb indentations; and finger indentations in said bight, said finger indentations being located toward an end of said bight.

11. The system of claim 10, wherein said hand implement is a claw-hammer or hatchet comprising a head.

12. The system of claim 11, wherein said head comprises an aperture.

13. The system of claim 11, wherein said head is integrally formed with said handle.

14. The system of claim 10, wherein a free end of said handle curves toward the front of said hand implement.

15. The system of claim 10, wherein a fixed end of said handle curves toward the rear of said hand implement.

* * * * *